United States Patent [19]

Whicker

[11] Patent Number: 4,729,229

[45] Date of Patent: Mar. 8, 1988

[54] KNITTING DEVICE

[75] Inventor: James H. Whicker, Nashville, Tenn.

[73] Assignee: Whicker Incorporated, Nashville, Tenn.

[21] Appl. No.: 24,392

[22] Filed: Mar. 10, 1987

[51] Int. Cl.[4] ..... D04B 3/00

[52] U.S. Cl. ..... 66/4

[58] Field of Search ..... 66/3, 4, 1 R

[56] References Cited

U.S. PATENT DOCUMENTS

| | | | |
|---|---|---|---|
| 1,776,561 | 9/1930 | La Croix . | |
| 2,072,668 | 3/1937 | Elfgroth . | |
| 2,134,066 | 10/1938 | Van Ness | 66/4 |
| 2,237,733 | 4/1941 | Grim et al. . | |
| 3,967,467 | 7/1976 | Leach | 66/4 |
| 4,248,063 | 2/1981 | Wang | 66/4 |
| 4,393,668 | 7/1983 | Leach | 66/4 |

FOREIGN PATENT DOCUMENTS 570244 6/1945 United Kingdom .

*Primary Examiner*—Ronald Feldbaum

*Attorney, Agent, or Firm*—Willian Brinks Olds Hofer Gilson & Lione

[57] ABSTRACT

This invention relates to an improved manual knitting device that is comprised of an elongated frame member that has an elongated slot throughout its central region. Parallel rows of pins are disposed along opposite sides of the slot. The rows are slightly offset from each other in the direction of elongation of the slot. The pins are flexible and are tapered to facilitate the knitting operation. The pins are integrally molded in a replaceable insert member that may be removed from the frame member of the device and replaced by another insert member that has pins that are spaced differently, of different diameters, or perhaps of different elastic characteristics.

14 Claims, 4 Drawing Figures

FIG 2
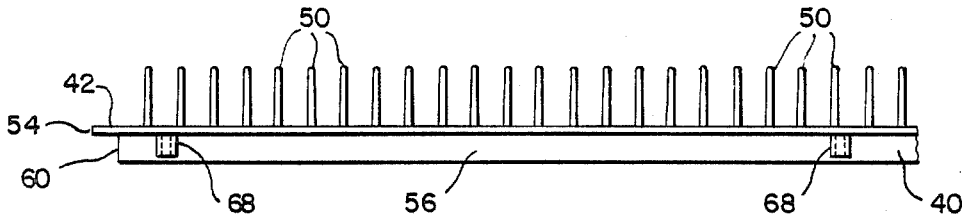
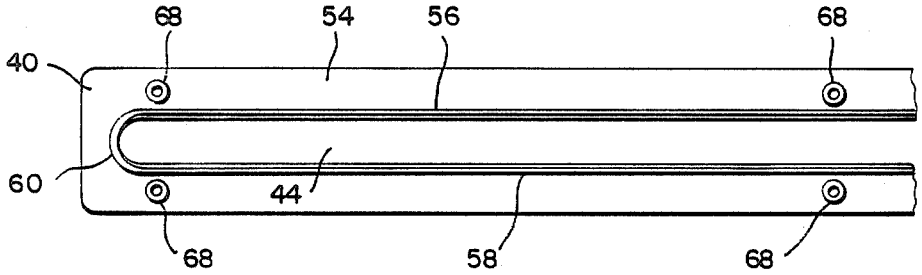
FIG 3
FIG 4
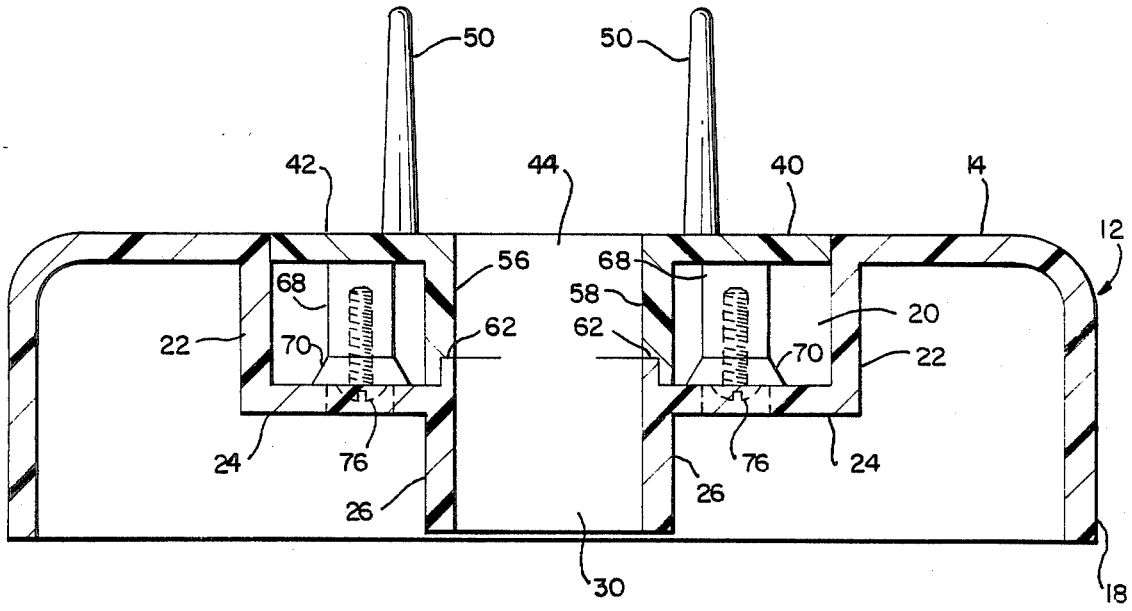

KNITTING DEVICE

This invention relates to an improved manual knitting device or loom that is in the form of an elongated board or frame that has a longitudinally extending slot extending completely through the center region of the frame. Parallel rows of pins or pegs are along opposite edges of the slot and yarn is passes back and forth between pins of the opposite rows in a desired pattern. This step of passing yarn back and forth between and around pins of the opposite rows is known as casting on the stitches. A second row of stitches in a desired pattern then is cast on the pins in a similar manner. The stitches are set, or formed, by picking up the bottom strand of yarn at each pin and lifting it up over the top strand and over the top of the pin. The described steps are repeated and as the knitted piece is formed it passes through the slot in the center of the frame. Various knitted patterns and designs may be formed by casting the yarn on the pins in the required stitch pattern. The spacing between adjacent pins in a row, the spacing between rows, i.e., the width of the slot, and the thickness of the pins, determine the general texture of the knitted piece.

The following United States patents show and describe various type of these manual knitting frames and various different stitches that can be cast on the frame. 1,776,561; 2,237,733; 2,072,668; 3,967,467; 4,158,296.

SUMMARY OF THE INVENTION

This invention relates to an improved manual knitting device that is comprised of an elongated frame member that has an elongated slot throughout its central region. Parallel rows of pins are disposed along opposite sides of the slot. The rows are slightly offset from each other in the direction of elongation of the slot. The pins are flexible and are tapered to facilitate the knitting operation. The pins are integrally molded in a replaceable insert member that may be removed from the frame member of the device and replaced by another insert member that has pins that are spaced differently, of different diameters, or perhaps of different elastic characteristics. Inserts having different characteristics may be desirable in knitting different types of cloth, or for knitting cloths for different end uses.

BRIEF DESCRIPTION OF THE DRAWINGS

My invention will be described by referring to the accompanying drawings wherein:

FIG. 2 is a side elevation view of a portion of the pin insert member that contains the pins shown in the device of FIG. 1 and which is insertable in the frame of the device of my invention;

FIG. 3 is a bottom view of pin insert member that is illustrated in FIG. 2; and

FIG. 4 is a sectional view taken at section 4—4 of FIG. 1.

DESCRIPTION OF PREFERRED EMBODIMENT

Figure 1:
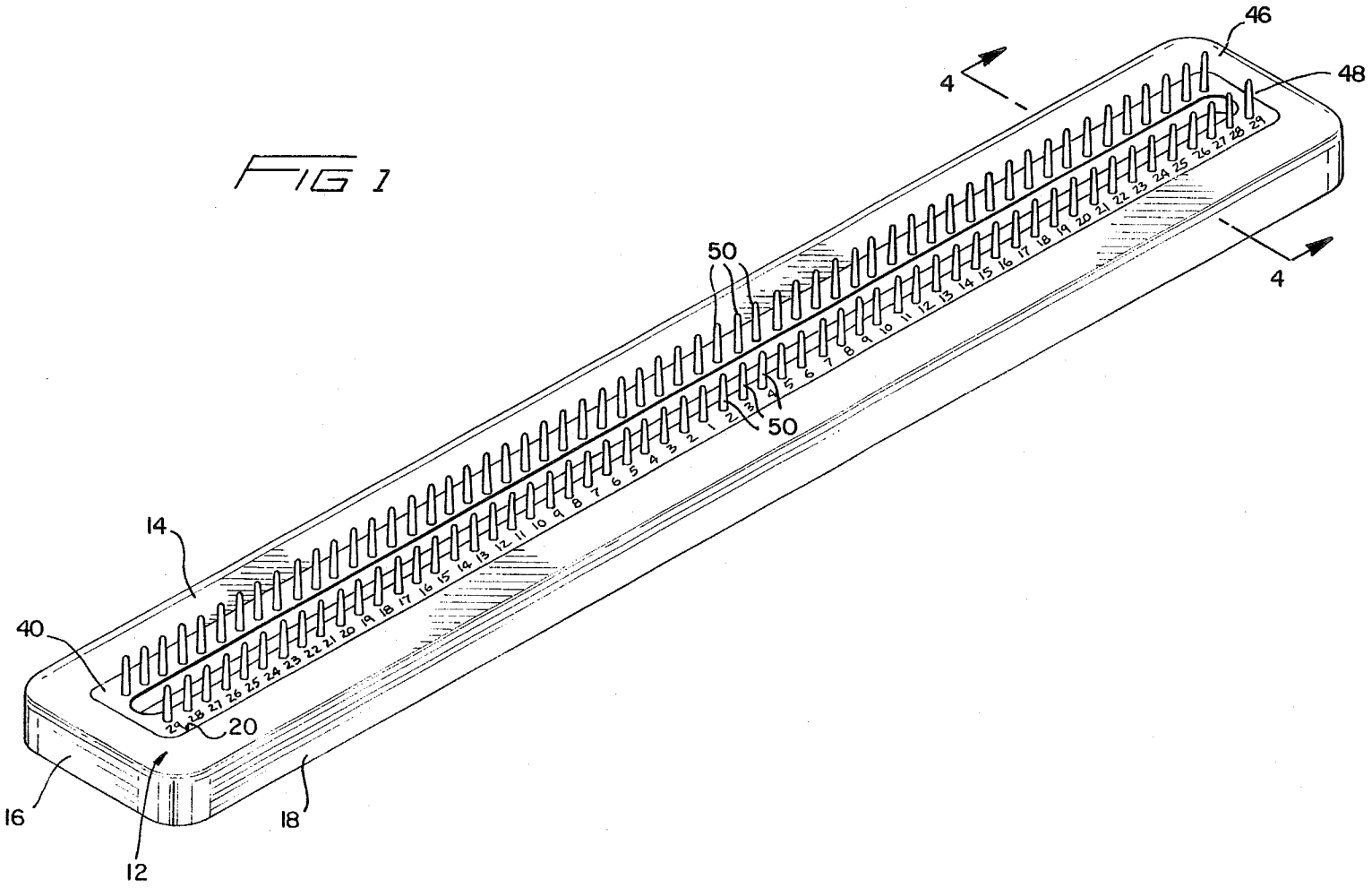
FIG. 1 is a perspective view of the novel knitting device of my invention.

Referring in detail to the drawings, the knitting device of my invention is comprised of a frame member 12 that has a substantially horizontal top surface 14, and end walls 16 and side walls 18 that extend downwardly substantially vertically. As best seen in FIG. 4, frame member 12 has a recessed region 20 that extends inwardly from the top surface 14. The recessed region 20 is comprised of short side walls 22 on opposite sides of the recess, opposite bottom walls 24, and spaced, short vertical walls 26 that form an elongated slot 30 that provides an elongated vertical passageway through the frame. As indicated in FIG. 1, the recessed region 20 extends longitudinally substantially the entire length of the frame 12, except for the end regions thereof. Recessed region 20 extends across the central region of frame 12, and its bottom walls 24 are approximately midway between top surface 14 and the bottom of the frame.

Frame 12 preferably is molded of a plastic material that is not brittle and will withstand a substantial amount of wear and tear during normal use without breaking or chipping. Because frame 12 is elongated and is open in its central region at recess 20, the plastic material must impart enough firmness and rigidity to the frame that it will hold its shape during use. Of course, the frame may be made of wood or any other suitable material.

Disposed within recessed region 20 is a pin insert member 40 which has a top surface 42 which is contiguous to, and substantially coplanar with, top surface 14 of frame member 12. A longitudinally extending slot 44 extends throughout the center region of the insert and is in vertical registration with slot 30 in the recessed region 20 of frame 12. First and second rows 46 and 48 of uniformly spaced pins 50 extend vertically upwardly from the top surface of pin insert member 40. The two rows of pins are parallel to each other, and each row is closely adjacent an edge of slot 44. The pins in one row are slightly offset longitudinally relative to the pins in the opposite row. In a preferred embodiment of my invention, row 46, FIG. 1, was longitudinally offset to the right from row 48 by a distance approximately equal to one to two times the base diameter of the pins. The spacing between the pins in each row is approximately equal to four to five times the base diameter of a pin.

Side and bottom views of pin insert member 40 are shown in FIGS. 2 and 3. As illustrated, the insert is comprised of a flat upper portion 54 that is rectangular in shape and sized to closely fit the open space formed in the top surface 14 of frame 12. Extending downwardly from the periphery of slot 44 are the integrally formed side walls 56 and 58. Curved ends 60 are integral to the side walls 56 and 58. Insert member 40 is identical at both ends.

It is seen in FIG. 4 that the bottom surfaces of integral side walls 56 and 58 are notched to receive the top ends of short vertical walls 26 in the recessed region of frame 12. The top ends of short vertical walls 26 of frame 12 serve to hold side walls 56 and 58 of insert 40 spread apart and anchored so that the inner vertical surfaces of mating pairs of those four walls remain substantially coplanar. Another way of expressing this relationship is to say that the slots 30 and 40 are maintained in vertical registration by means of the slotted interlocking connection between the bottom ends of walls 56 and 58 and the top ends of walls 26. Other suitable interlocking means may be employed to maintain the described arrangement.

Disposed along the bottom surface of top portion 54 of pin insert member 40 are a pair of rows of uniformly spaced support studs 68. Support studs 68 are molded integrally with pin insert member 40 and extend down into recessed region 20 so that their bottom ends rest on respective hollow truncated studs 70, FIG. 4. Support studs 68 are provided with internal threads. Screws 76 fasten studs 68, and thus pin insert 40, to the lower walls 24 of frame 12. There may be six to eight, or more, support studs 68 and corresponding screws 74 in each of the two rows.

Desirably, pin insert member 40 with pins 50 thereon is molded as an integral unit from a different composition of plastic material than is used for frame 12. The reason for this is that frame member 12 should be relatively stiff to provide adequate support for the pin insert member, and to provide a self supporting frame. On the other hand, it is desirable that pins 50 be flexible at their outer end regions to facilitate casting the yarn onto the pins, and in setting the stitches, i.e., lifting the bottom strand of yarn over the top strand at each pin. Although the outer portions of the pins are flexible, the base regions of the pins where they join flat surface 42 of the insert 40 should be rigid enough to maintain their positions relatively fixed without drifting or moving due to tension on the yarn that is about the pin.

As seen in FIG. 4, each pin is uniformly tapered from its base to its outer tip. This serves not only to aid in making the tips flexible, but also serves to provide more spacing between the tips, thereby facilitating the casing on of yarn on the pins. Furthermore, the tapering of the pins makes it easier to remove from the pins and then replace back onto the pins a partially completed piece of cloth. When the yarn is first passed about the pins in the opposite rows 46, 48 in the manner described above, the yarn most likely engages the pins somewhere between the top and base ends. Indeed, to speed up the process of casting on, it is desirable not to take too much time in precisely positioning the yarn on the pins. After the yarn is cast on the pins to set the desired stitch pattern, the user then uses his fingers or a tool and pushes the yarn on all the pins to the base regions of the pins. The fact that the pins are tapered and flexible and can be bent by tension in the yarn that passes about them causes the lengths of yarn that pass back and forth between the rows of pins to become relatively uniformly tensioned along the length of the device as the yarn is pushed downwardly toward the bases of the pins. This uniformity in tension in the lengths of yarn contributes to a more uniformly knitted finished product. The tapered and flexible pins are considered to be important features in the improved knitting device of my invention.

In a presently preferred embodiment of the invention intended for general use, the pins are approximately 20 mm long, are approximately 2.5 mm in diameter at their bases and approximately 2.0 mm in diameter at their outer tip region. The pins are flexible throughout all but their very lower base regions. The exact physical dimensions and material composition are best arrived at empirically, depending on the type of yarn to be used and type of cloth to be made. As discussed below, it may be desirable to have different pin insert members having pins of respective different physical size, spacing, etc., to be used with different types of yarn to produce different types of cloth. In an embodiment of my invention intended for general use, the material of pin insert member 40 was comprised of approximately 90 percent of a high impact polypropolene plastic material, and the remainder a general plastic with perhaps some stiffener added, that does not impart brittleness to the insert, and permits the pins 50 to be elastic and yet provide adequate support for the yarn and product during work. Many suitable plastic materials are known that may be used in molding insert member 40, and may be used if desired. Because the pins will experience considerable abuse during the life of the device, i.e., when the device is dropped, for example, they must be made of a material that will survive such use. Because the plastic material is not the subject of my invention, it will not be further described.

The fact that pin insert member 40 is made as a separate member that is insertable in frame 12 has several advantages. First, the desired physical characteristics of the pins are different from any other part of the device. They must be flexible and yieldable, while the frame must be more rigid. Therefore, each part of my device may have its optimum desired characteristics without interfering with or detracting from those of the other part of the device. A second advantage is that different pin inserts may be provided that have different spacings between pins in a row, different widths of slots through the device, and different diameter pins. Further, different materials may be used in molding different inserts, depending on the characteristics desired. These all contribute to the ability to make different finished pieces having different textures. For example, in making a scarf to be worn about the neck, it is desired that the stitches be fine and close together. This requires that the pins be relatively close together and of relatively small diameter, and that the slot be relatively narrow so that the scarf will have closely spaced stitches. On the other hand, for making cloth for a large item such as an afgan or blanket where thicker yarn is used, it might be desirable to substitute a pin insert member 40 having greater spacing between pins of greater diameter, and having a wider slot in the central region. It thus may be seen that having a replaceable insert adds versatility to the knitting device of my invention.

As seen in FIG. 1, numerals are molded into the top surface 42 of insert member 40 adjacent the bases of pins 50. The center pin of row 48 is given number one, and each pin on opposite sides of pin one is given number two. The sequence of numbering continues progressively on both sides of the center pin out to the end pins. In one embodiment of my invention, the pins on the ends were numbered 29, for a total of 59 pins in each row. Numbering of the pins assists the user in following a desired pattern when casting on the stitches, and also readily establishes a center for the pattern of stitches. Any number of pins may be utilized in setting up a pattern. Because transversely extending slots 44 and 30 extend beyond the last pins in the two rows, they will accommodate any size of cloth that is knitted on the pins.

From the above description it may be seen that the improved knitting device of my invention is a durable, easy to use device that produces an excellent quality of cloth. The tapered and flexible pins, and the replaceable pin insert member contribute significantly to the ease of use and improved product.

In its broader aspects, this invention is not limited to the specific embodiment illustrated and described. Various changes and modifications may be made without departing from the inventive principles herein disclosed.

I claim:

1. A manual knitting frame, comprising a frame member having a top surface and downwardly depending side surfaces, a slot extending through said frame member to provide a passageway from top to bottom therethrough, a pin insert member having a slot passing therethrough to provide a passageway from its top to its bottom, vertically extending pins disposed adjacent the slot on said insert member, said frame member and pin insert members being constructed and arranged for the insert member to fit on said frame member with their slots in vertical registration, and means for selectively securing said pin insert member on said frame member.

2. The manual knitting frame claimed in claim 1 wherein said pins are substantially uniformly spaced apart along the edge of said slot in the insert member, and wherein said pins are flexible at least at their outer and regions.

3. The manual knitting frame claimed in claim 1 wherein the pins on one side of said slot are longitudinally offset relative to the pins on the other side said slot.

4. The manual knitting device claimed in claim 2 wherein said pins are substantially uniformly tapered from their bases to their outer tips.

5. The manual knitting frame claimed in claim 1 and including interlock means on said frame member and/or insert member for maintaining said insert member in position relative to said frame member.

6. The manual knitting frame claimed in claim 5 herein said insert member is molded from a plastic material as an integral unit that includes said pins.

7. The manual knitting frame claimed in claim 6 wherein said frame member is molded from a plastic material that has different physical characteristics than the material of said insert member.

8. The manual knitting frame claimed in claim 7 wherein said frame member is elongated and its slot also is elongated and extends throughout the central region of the frame member.

9. The manual knitting frame claimed in claim 8 wherein said frame member has a recessed region in its central region and its slot extends through said recessed region.

10. The manual knitting frame claimed in claim 9 wherein said insert member is constructed to fit in said recessed region of the frame member with the respective slots of the two members in vertical registration.

11. The manual knitting frame claimed in claim 10 wherein said frame member and insert member both have flat top surfaces and the two surfaces are coplanar when the insert member is within the recessed region of the frame member.

12. A manual knitting frame, comprising an elongated frame member having a substantially horizontal top surface and downwardly depending side surfaces, an elongated recess extending downwardly from said surface and having a portion thereof extending across the central region of said frame, an elongated slot extending through said recess to provide a passageway from top to bottom through said frame, a pin insert member comprised of an elongated member having a slot passing through its center region to leave a hollow frame, parallel rows of vertically extending, substantially uniformly spaced pins disposed on opposite edges of said slot on the pin insert member, said pin insert member being constructed and arranged to fit in said recess in the frame member with its top surface substantially flush with said horizontal top surface of the frame, and with its slot in vertical registration with the elongated slot in said recess, and means for selectively securing said pin insert member in said recess.

13. A manual knitting frame, comprising an elongated frame member having a top surface and downwardly depending side surfaces, an elongated recess extending across the central region of said frame, an elongated slot extending through said recess to provide a passageway from top to bottom through said frame, a pin insert member comprised of an elongated member having a slot passing through its center region, parallel rows of vertically extending pins disposed on respective edges of said slot on the pin insert member, said pin insert member being constructed and arranged to fit in said recess in the frame member with its top surface substantially flush with said top surface of the frame, and with its slot in vertical registration with the elongated slot in said recess, and means for selectively securing said pin insert member in said recess.

14. The manual knitting frame claimed in claim 13 wherein the pins on one side of said slot are longitudinally offset relative to the slot on the other side of said slot.

* * * * *